US012396493B1

(12) United States Patent
Dumaplin

(10) Patent No.: US 12,396,493 B1
(45) Date of Patent: Aug. 26, 2025

(54) SWADDLE BLANKET

(71) Applicant: Cara Dumaplin, Glendale, AZ (US)

(72) Inventor: Cara Dumaplin, Glendale, AZ (US)

( * ) Notice: Subject to any disclaimer, the term of this patent is extended or adjusted under 35 U.S.C. 154(b) by 0 days.

(21) Appl. No.: 19/199,088

(22) Filed: May 5, 2025

(51) Int. Cl.

| | |
|---|---|
| ***A41B 13/06*** | (2006.01) |
| ***A41B 13/00*** | (2006.01) |
| ***A44B 13/00*** | (2006.01) |
| ***A47D 15/00*** | (2006.01) |

(52) U.S. Cl.
CPC ..... *A41B 13/06* (2013.01); *A44B 13/00* (2013.01); *A47D 15/005* (2013.01); *A47D 15/00* (2013.01)

(58) Field of Classification Search
CPC ..... A41B 13/06; A41B 13/065; A41B 13/00; A47G 9/02; A47G 9/04; A47G 9/08; A47G 9/083; A47D 15/005; A47D 15/008; A47D 15/00
USPC ..... 5/494, 496, 482, 486, 655, 657, 652
See application file for complete search history.

(56) References Cited

U.S. PATENT DOCUMENTS

| | | | | |
|---|---|---|---|---|
| 3,693,190 | A * | 9/1972 | Hickling | A41B 13/06 2/69.5 |
| 3,739,399 | A * | 6/1973 | Sheahon | A41D 13/1272 2/69.5 |
| 4,897,885 | A * | 2/1990 | Lunt | A41B 13/06 2/70 |
| 5,046,204 | A * | 9/1991 | Mohler | A41B 13/06 5/413 R |
| 5,722,094 | A * | 3/1998 | Ruefer | A41B 13/06 2/69.5 |
| 6,341,397 | B1 * | 1/2002 | Kliegl | A41B 13/06 2/69.5 |
| 6,415,442 | B1 * | 7/2002 | Smith | A41B 13/06 2/69.5 |
| 6,640,340 | B2 * | 11/2003 | Gibson | A41B 13/06 2/69.5 |
| 6,662,390 | B1 * | 12/2003 | Berger | A41B 13/06 5/655 |
| 6,839,924 | B2 * | 1/2005 | Sims | A41B 13/06 5/413 R |
| 6,928,674 | B2 * | 8/2005 | Blackburn | A41B 13/06 5/413 R |
| 7,254,849 | B1 * | 8/2007 | Fiebrich | A41B 13/06 5/923 |
| 7,774,875 | B1 | 8/2010 | Zeidman | |
| 7,900,301 | B2 | 3/2011 | Tatsuno | |
| 8,191,188 | B2 | 6/2012 | Kaplan et al. | |
| 8,347,432 | B2 * | 1/2013 | Schmid | A41B 13/06 5/413 R |
| 8,539,620 | B1 | 9/2013 | Wynh | |

(Continued)

OTHER PUBLICATIONS

Noiseless Patented-Velcro Baby Infant Wrap Swaddle Blankets for Newborn Baby Boys Girls 0-3 Months, Wearable Swaddle Sleep Sacks Easy Diaper Changing Sleeping Bag with Zipper, https://www.amazon.com/Knirose-Patented-Velcro-Adjustable-Blankets-Wearable/dp/B0BJK9RG4R/ref=sr_1_6?crid=1OUGNV9T73OKL&dib=eyJ2ljoiMSJ9.tJ5Co9BvLp9UPHjMHLGYpdZx8_Slm5BrlKzQfl5Fr94krrTdmpJeEdfJIRIB0Sb9fB8FJ9aGsBbcvPkkPCReVH5gmneT4gOgTdQwSIIJYM6Uruek8bE3MwjQ5JJkFtGnmVBRMHXldWxD445XQXaV0wk-4bBjSTxvghJO7TjGFr3Z7eHaYI-.

*Primary Examiner* — Robert G Santos
(74) *Attorney, Agent, or Firm* — Shane Cortesi

(57) ABSTRACT

A swaddle blanket and band are described. The blanket and band may be used alone or in combination. The blanket and band may utilize panels of hook and loop fasteners (e.g., silent hook and loop fasteners) that may be sewn onto a base fabric to allow for ease of swaddling. In addition, the blanket may utilize a strap that folds and attaches to itself to form a loop to secure a lower portion of the blanket and provide size adjustability/remove excess slack.

23 Claims, 12 Drawing Sheets

(56) References Cited

U.S. PATENT DOCUMENTS

| | | | | |
|---|---|---|---|---|
| 8,650,663 | B2 | 2/2014 | Fair et al. | |
| 8,667,631 | B2 | 3/2014 | Coates | |
| 8,776,265 | B2 * | 7/2014 | Neveu | A47G 9/068 2/69.5 |
| 8,782,831 | B2 | 7/2014 | Houston et al. | |
| 8,898,833 | B2 | 12/2014 | Coates | |
| 9,131,734 | B2 | 9/2015 | Daugherty et al. | |
| 10,165,802 | B2 | 1/2019 | Clouse et al. | |
| 10,463,168 | B2 | 11/2019 | Karp et al. | |
| 10,709,174 | B2 | 7/2020 | Stephan et al. | |
| 11,147,319 | B2 | 10/2021 | Karp et al. | |
| 11,470,888 | B2 | 10/2022 | Zeidman | |
| 11,490,663 | B2 | 11/2022 | Karp et al. | |
| 11,622,585 | B1 | 4/2023 | Skeath | |
| 11,647,848 | B1 * | 5/2023 | Coates | A41B 13/06 5/494 |
| D1,003,571 | S | 11/2023 | Lee | |
| D1,007,814 | S | 12/2023 | Walker | |
| 11,903,428 | B2 | 2/2024 | Zeidman | |
| 11,910,841 | B2 | 2/2024 | Zeidman | |
| 12,022,890 | B2 | 7/2024 | Barnard et al. | |
| 12,171,278 | B2 | 12/2024 | Zeidman | |
| 12,232,545 | B2 | 2/2025 | Zeidman | |
| 2003/0131411 | A1 * | 7/2003 | Gibson | A41B 13/06 2/69.5 |
| 2004/0158925 | A1 * | 8/2004 | Sims | A41B 13/06 5/494 |
| 2004/0216230 | A1 * | 11/2004 | Blackburn | A41B 13/06 2/69.5 |
| 2006/0010600 | A1 * | 1/2006 | Kendy | A47D 15/005 5/482 |
| 2011/0231993 | A1 * | 9/2011 | Schmid | A41B 13/06 2/69.5 |
| 2012/0023637 | A1 * | 2/2012 | Neveu | A41B 13/06 2/69.5 |
| 2014/0020176 | A1 * | 1/2014 | Coates | A41B 13/06 5/494 |
| 2014/0020177 | A1 * | 1/2014 | Coates | A41B 13/06 5/494 |
| 2014/0298564 | A1 | 10/2014 | Miller | |
| 2023/0074593 | A1 | 3/2023 | Zeidman | |

* cited by examiner

SWADDLE BLANKET

BACKGROUND

Technical Field

The present invention relates to swaddle blankets.

Background of the Invention

Swaddle blankets are known in the art. Examples include those described in U.S. Pat. Nos. 7,774,875, 11,622,585 and 9,131,734.

There is a continuing need for comfortable swaddle blankets that are versatile, promote sleep, are easy to use, and do not disturb the child.

SUMMARY OF THE INVENTION

Figure 1:
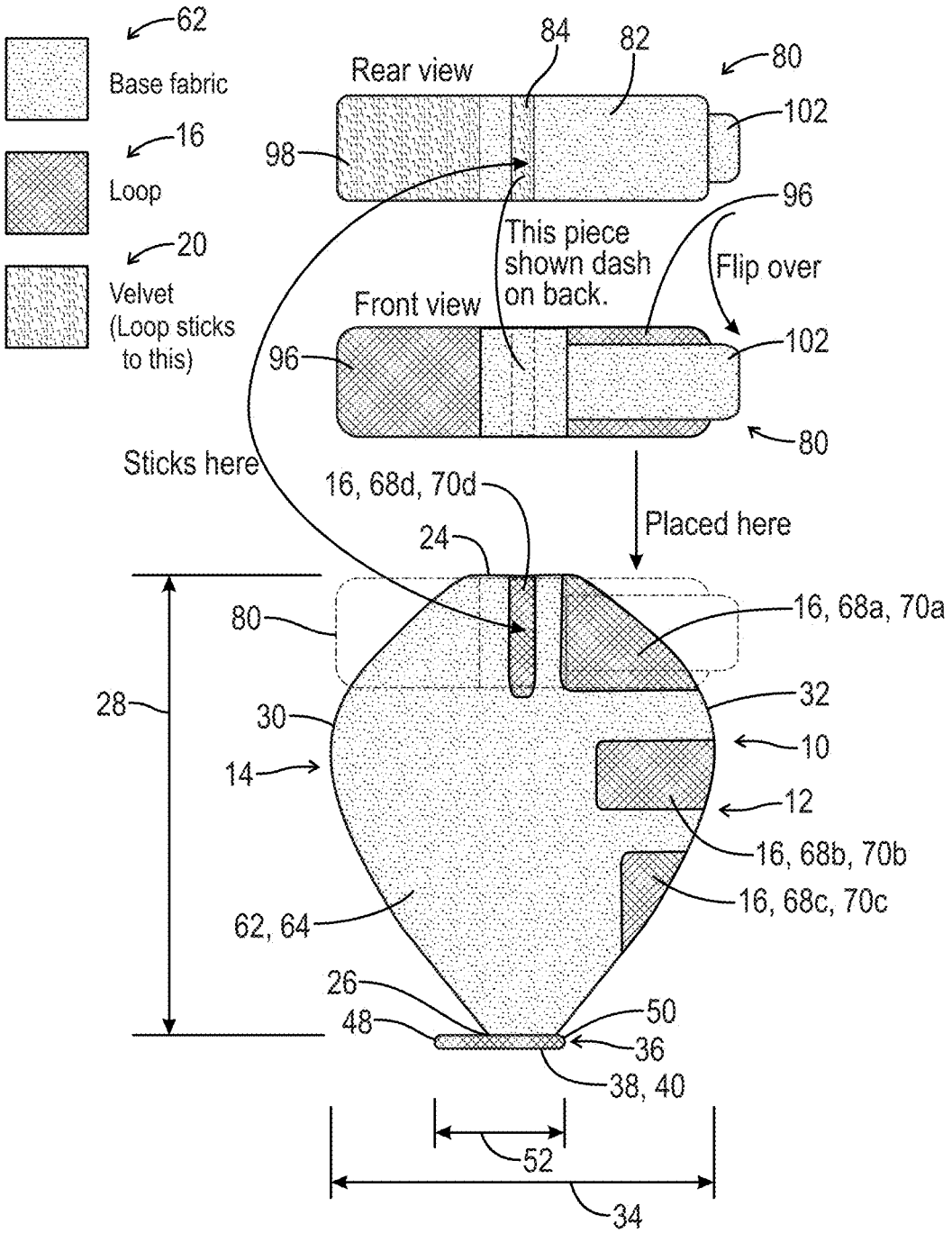
FIG. 1 illustrates rear and front elevation views of a band and a front elevation view of a swaddle blanket in accordance with one embodiment of the present invention; in particular the top drawing is a rear view of the band, the middle drawing is a front view of the band, and the bottom drawing is a front view of the swaddle blanket with dashed lines to show how the band removably attaches to the swaddle blanket.
Figure 2:
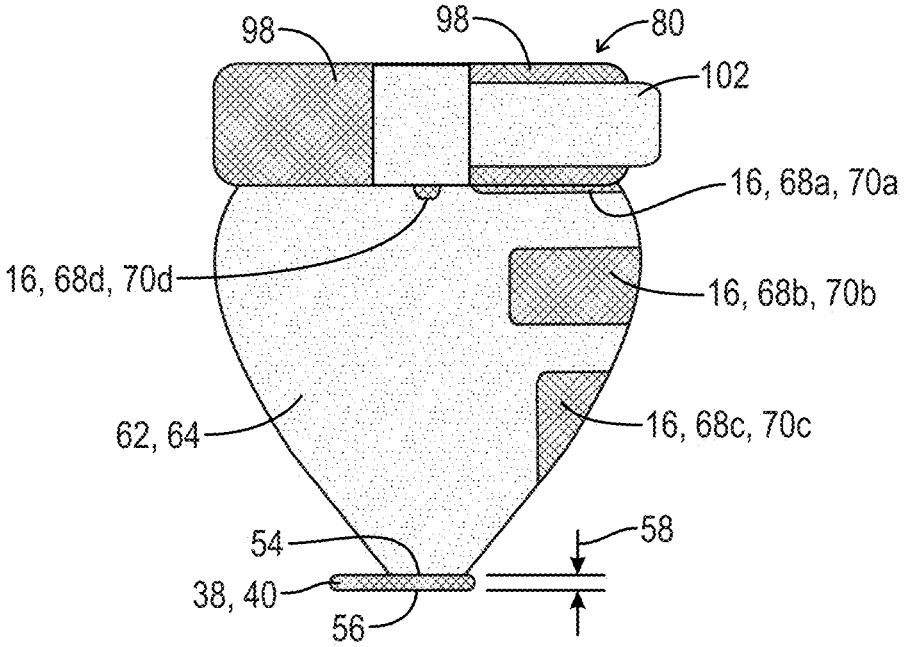
FIGS. 2-11 and FIG. 11A illustrate, in a stepwise manner, how the band and swaddle blanket of FIG. 1 may be used to swaddle a child.
Figure 3:
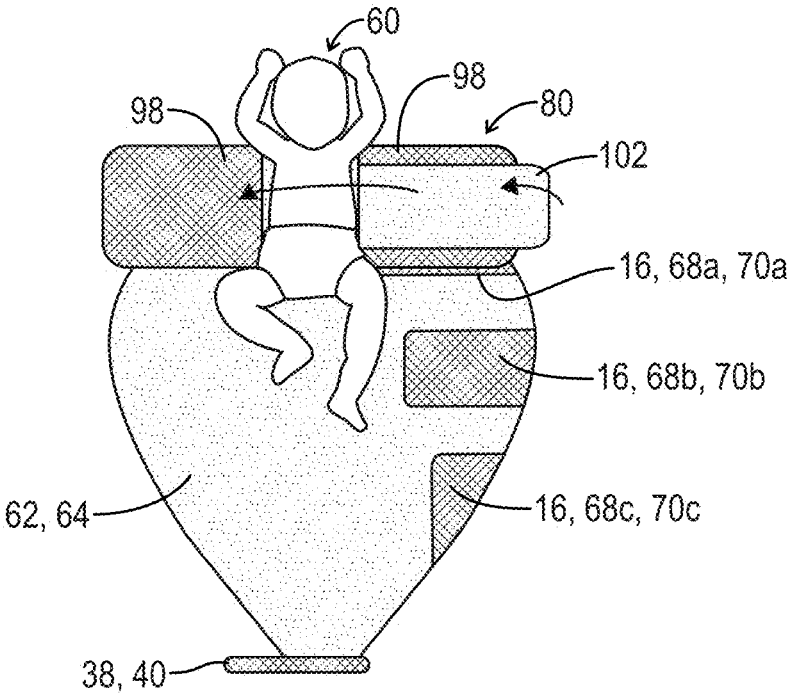
Figure 4:
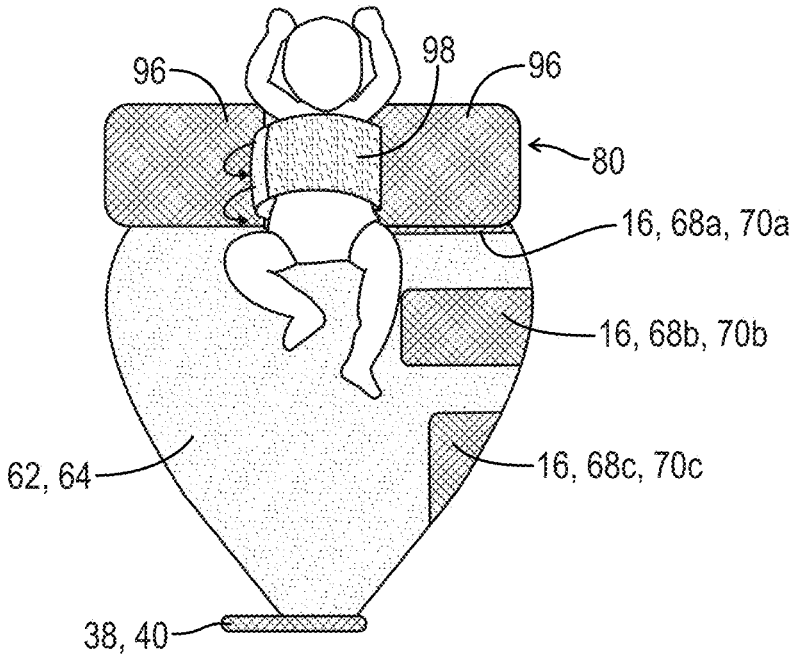
Figure 5:
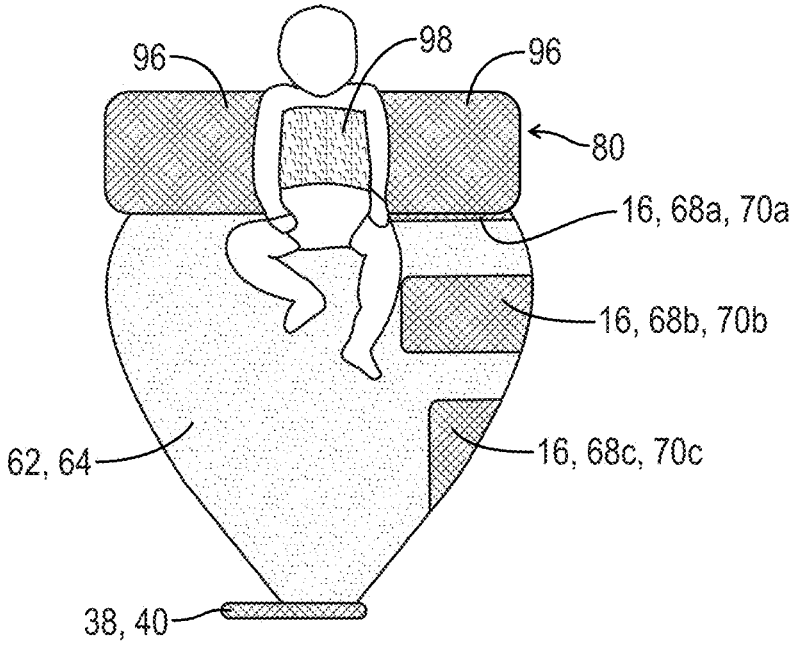
Figure 6:
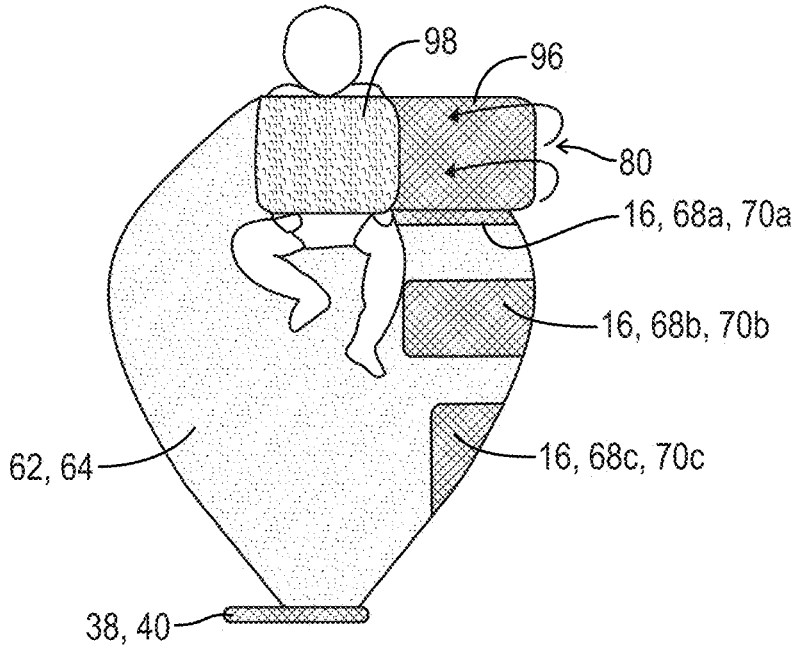
Figure 7:
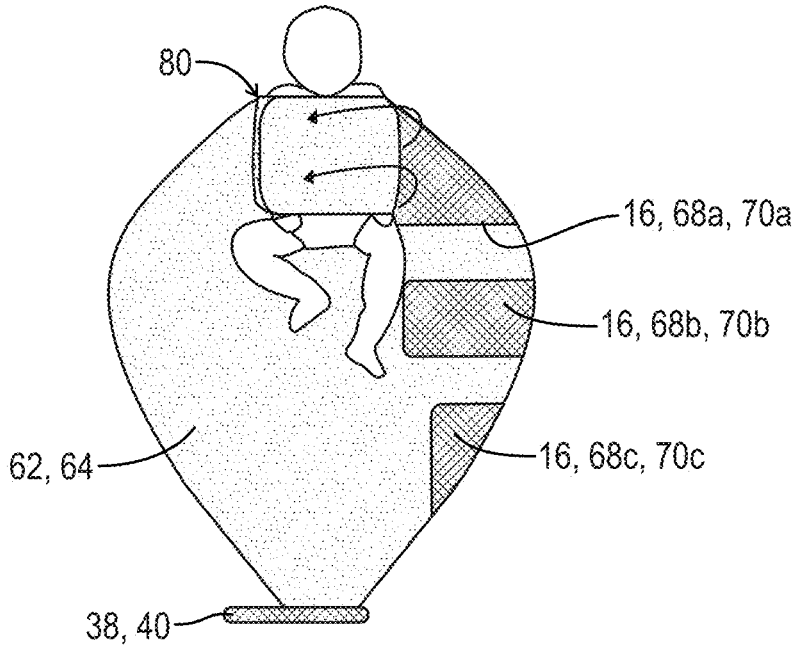
Figure 8:
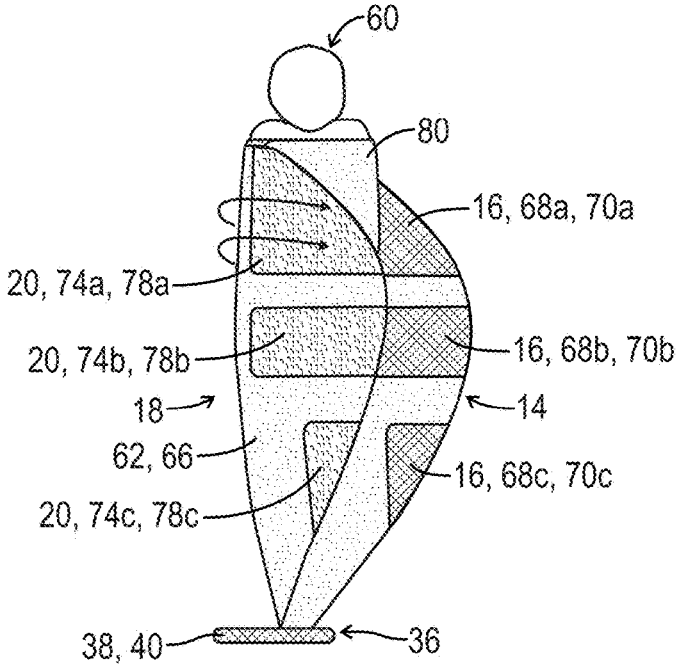
Figure 9:
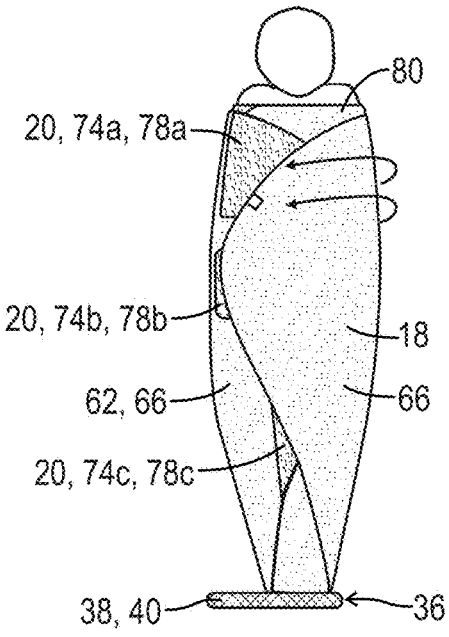
Figure 10:
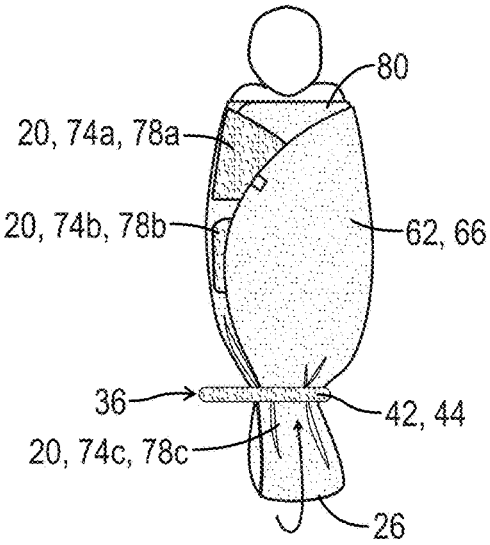

In some embodiments, the present disclosure provides a swaddle blanket as described herein.

In some embodiments, the swaddle blanket comprises a blanket body that may comprise a) a blanket front; b) a blanket rear; c) a blanket thickness extending from the blanket front to the blanket rear; d) a blanket top; e) a blanket bottom; f) a blanket height extending from the blanket top to the blanket bottom and perpendicular to the blanket thickness; g) a blanket left side; h) a blanket right side; i) a blanket width extending from the blanket left side to the blanket right side and perpendicular to the blanket height and blanket thickness; j) one or more base fabric panels that may comprise a front forming a portion of the blanket front and a rear forming a portion of the blanket rear; k) a plurality of female fastener panels sewn to the one or more base fabric panels, optionally wherein at least some of the female fastener panels comprise a front forming a portion of the blanket front and comprising loop fasteners; and/or l) a plurality of male fastener panels that may be sewn to the one or more base fabric panels, optionally wherein at least some of the male fastener panels comprise a rear forming a portion of the blanket rear and comprising hook fasteners configured to releasably attach to the loop fasteners. Optionally, the blanket left side is foldable relative to the blanket right side to allow the blanket body to wrap around and swaddle a child. Optionally, the hook fasteners and loop fasteners are silent hook and loop fasteners. Optionally, the portions of the blanket rear that are aligned heightwise and widthwise with the female fastener panel fronts do not include a hook or loop fastener and the portions of the blanket front that are aligned heightwise and widthwise with the male fastener panel rears do not include a hook or loop fastener. Optionally, for each female fastener panel, the respective loop fastener covers substantially all of the female fastener panel front, and wherein for each male fastener panel, the respective hook fastener covers substantially all of the male fastener panel rear. Optionally, the right side of the blanket front comprises an upper female fastener panel comprising a front comprising a loop fastener, a middle female fastener panel located below the upper female fastener panel and comprising a front comprising a loop fastener, and a lower female fastener panel located below the middle female fastener panel and comprising a front comprising a loop fastener. Optionally, the left side of the blanket rear comprises an upper male fastener panel aligned vertically with the upper female fastener panel and comprising a rear comprising a hook fastener, a middle male fastener panel located below the upper male fastener panel and aligned vertically with the middle female fastener panel and comprising a rear comprising a hook fastener, and a lower male fastener panel located below the middle male fastener panel and aligned vertically with the lower female fastener panel and comprising a rear comprising a hook fastener. Optionally, the upper female fastener panel is the same size and shape as the upper male fastener panel, wherein the middle female fastener panel is the same size and shape as the middle male fastener panel, and further wherein the lower female fastener panel is the same size and shape as the lower male fastener panel. Optionally, the blanket front further comprises a center female fastener panel located between the upper female fastener panel and the upper male fastener panel and comprising a front comprising a loop fastener. Optionally, the swaddle blanket further comprises a removable rectangular band comprising a rear comprising a hook fastener configured to releasably attach to the loop fastener of the center female fastener panel. Optionally, the one or more base fabrics is located between the upper female fastener panel and the middle female fastener panel, and between the middle female fastener panel and the lower female fastener panel. Optionally, the width of the upper female fastener panel is greater than the width of the middle female fastener panel and further wherein the width of the middle female fastener panel is greater than the width of the lower female fastener panel. Optionally, the height of the upper female fastener panel is greater than the height of the middle female fastener panel and/or the height of the lower female fastener panel is greater than the height of the middle female fastener panel. Optionally, the base fabric panel is comprised of modal fabric. Optionally, the male fastener panel rear is comprised of velvet. Optionally, the female fastener panel front is comprised of loop fabric. Optionally, the swaddle blanket further comprises a strap located adjacent the blanket bottom and comprising a strap front comprising a strap front fastener, a strap rear comprising a strap rear fastener configured to releasably attach to the strap front fastener, a strap thickness extending from the strap front to the strap rear and parallel to the blanket thickness, a strap left side, a strap right side, a strap width extending from the strap left side to the strap right side and perpendicular to the strap thickness, a strap top, a strap bottom, and a strap height extending from the strap top to the strap bottom and perpendicular to the strap width and the strap thickness and parallel to the blanket height. Optionally, the strap is configured to transition from a flat position in which the strap is flat to a looped position in which the strap removably folds around itself and the strap front fastener attaches to the strap rear fastener so that the strap forms a loop. Optionally, the strap front fastener is a loop fastener and further wherein the strap rear fastener is a hook fastener. Optionally, one of the strap front and the strap rear consist of loop fabric and the other of the strap front and the strap rear consist of hook fabric and further wherein the loop fabric is sewn to the hook fabric. Optionally, the strap front fastener covers the strap front and/or the strap rear fastener covers the strap rear. Optionally, the strap rear is located to the rear of the blanket rear in the flat position and in the looped position. Optionally, the strap width is greater than the strap height. Optionally, the strap is located below the blanket bottom and further wherein the strap width is greater than the blanket width at the blanket bottom. Optionally, the strap width is from about 5 inches to about 10 inches and the strap height is from about 0.5 inches to about 2 inches. Optionally, the blanket width is variable and comprises a maximum width of between about 25 inches and about 35 inches. Optionally, the blanket is symmetrical about a longitudinal axis extending from a widthwise center of the blanket top to a widthwise center of the blanket bottom, said longitudinal axis parallel to the blanket height. Optionally, the blanket height is between about 25 inches and about 35 inches. Optionally, the blanket thickness is between about 0.001 inches and about 0.5 inches. Optionally, the blanket front does not have any hook fasteners and the blanket rear does not have any loop fasteners. Optionally, one or more of the of loop fasteners is aligned along the blanket height with a hook fastener (fasteners are aligned vertically). Optionally, the swaddle blanket further comprises a removable rectangular band comprising a rear comprising a first hook fastener and a second hook fastener, the second hook fastener configured to releasably attach to a blanket loop fastener. Optionally, the removable rectangular band comprises a front comprising a loop fastener configured to releasably attach to the first hook fastener. Optionally, the swaddle blanket comprises a middle segment located between the blanket top and blanket bottom, and further wherein the blanket width at the middle segment is greater than the blanket width at the blanket top and blanket bottom. Optionally, the blanket width at the blanket top is greater than the blanket width at the blanket bottom. Optionally, the blanket width is variable (due to the panels).

Optionally, the swaddle blanket is used in a method of using a swaddle blanket comprising the steps of: a) providing the swaddle blanket; b) placing a child on the blanket body; and c) wrapping the swaddle blanket around the child. Optionally, the method further comprises: d) releasably attaching at least one male fastener panel to at least one female fastener panel. Optionally, the swaddle blanket further comprises a strap located adjacent the blanket bottom and comprising a strap front comprising a strap front fastener, a strap rear comprising a strap rear fastener configured to releasably attach to the strap front fastener, a strap thickness extending from the strap front to the strap rear and parallel to the blanket thickness, a strap left side, a strap right side, and a strap width extending from the strap left side to the strap right side and perpendicular to the strap thickness, a strap top, a strap bottom, and a strap height extending from the strap top to the strap bottom and perpendicular to the strap width and the strap thickness and parallel to the blanket height. Optionally, the strap is configured to transition from a flat position in which the strap is flat to a looped position in which the strap removably folds around itself and the strap front fastener attaches to the strap rear fastener so that the strap forms a loop located in front of the blanket front and/or located to the rear of the blanket rear; and the method further comprises e) attaching the strap front fastener to the strap rear fastener. Optionally, the method further comprises the step of folding the blanket bottom upwards towards the blanket top before step e).

In still further embodiments, the present disclosure provides a swaddle blanket that may comprise a) a blanket body that may comprise i) a blanket front that may comprise a plurality of blanket female fasteners; ii) a blanket rear that may comprise a plurality of blanket male fasteners configured to releasably attach to the blanket female fasteners; iii) a blanket thickness extending from the blanket front to the blanket rear; iv) a blanket top; v) a blanket bottom; vi) a blanket height extending from the blanket top to the blanket bottom and perpendicular to the blanket thickness; vii) a blanket left side; viii) a blanket right side; and/or ix) a blanket width extending from the blanket left side to the blanket right side and perpendicular to the blanket height and blanket thickness. The swaddle blanket may also include b) a strap that may be located adjacent the blanket bottom and may comprise a strap front comprising a strap front fastener, a strap rear comprising a strap rear fastener configured to releasably attach to the strap front fastener, a strap thickness extending from the strap front to the strap rear and parallel to the blanket thickness, a strap left side, a strap right side, a strap width extending from the strap left side to the strap right side and perpendicular to the strap thickness, a strap top, a strap bottom, and a strap height extending from the strap top to the strap bottom and perpendicular to the strap width and the strap thickness and parallel to the blanket height. Optionally, the blanket left side is foldable relative to the blanket right side to allow the blanket body to wrap around and swaddle a child. Optionally, the strap is configured to transition from a flat position in which the strap is flat to a looped position in which the strap removably folds around itself and the strap front fastener attaches to the strap rear fastener so that the strap forms a loop. The swaddle blanket may include one or more features described above, in any combination. For example, optionally, the swaddle blanket is comprised of one or more base fabric panels sewn to a) a plurality of male fastener panels and b) a plurality of female fastener panels, and optionally, further wherein each female fastener panel comprises i) a female fastener panel front comprising a blanket female fastener and forming a portion of the blanket front; and ii) a male fastener panel comprising a male fastener panel rear comprising a blanket male fastener and forming a portion of the blanket rear. Optionally, the portions of the blanket rear that are aligned heightwise and widthwise with the female fastener panel fronts do not include a hook or loop fastener and further wherein the portions of the blanket front that are aligned heightwise and widthwise with the male fastener panel rears do not include a hook or loop fastener. Optionally, for each female fastener panel, the respective blanket female fastener covers substantially all of the female fastener panel front, and wherein for each male fastener panel, the respective male fastener covers substantially all of the male fastener panel rear. Optionally, the right side of the blanket front comprises an upper female fastener panel comprising a front comprising a blanket female fastener, a middle female fastener panel located below the upper female fastener panel and comprising a front comprising a blanket female fastener, and a lower female fastener panel located below the middle female fastener panel and comprising a front comprising a blanket female fastener. Optionally, the left side of the blanket rear comprises an upper male fastener panel aligned vertically with the upper female fastener panel and comprising a rear comprising a blanket male fastener, a middle male fastener panel located below the upper male fastener panel and aligned vertically with the middle female fastener panel and comprising a rear comprising a blanket male fastener, and a lower male fastener panel located below the middle male fastener panel and aligned vertically with the lower female fastener panel and comprising a rear comprising a blanket male fastener. Optionally, the upper female fastener panel is the same size and shape as the upper male fastener panel, wherein the middle female fastener panel is the same size and shape as the middle male fastener panel, and further wherein the lower female fastener panel is the same size and shape as the lower male fastener panel. Optionally, the blanket further comprises a center female fastener panel located between the upper female fastener panel and the upper male fastener panel and comprising a front comprising a blanket female fastener. Optionally, the swaddle blanket further comprises a removable rectangular band comprising a rear comprising a male band attachment fastener configured to releasably attach to the blanket female fastener of the center female fastener panel. Optionally, the one or more base fabrics is located between the upper female fastener panel and the middle female fastener panel and between the middle female fastener panel and the lower female fastener panel. Optionally, the width of the upper female fastener panel is greater than the width of the middle female fastener panel and further wherein the width of the middle female fastener panel is greater than the width of the lower female fastener panel. Optionally, the height of the upper female fastener panel is greater than the height of the middle female fastener panel and/or the height of the lower female fastener panel is greater than the height of the middle female fastener panel. Optionally, the strap front fastener is a female fastener and further wherein the strap rear fastener is a male fastener. Optionally, the base fabric panel is comprised of modal fabric. Optionally, the male fastener panel rear is comprised of velvet. Optionally the blanket female fastener panel front is comprised of loop fabric.

DETAILED DESCRIPTION

Certain preferred embodiments are shown in FIGS. 1-32 of the drawings where a swaddle blanket is generally designated by the numeral 10 and the band is generally designated by the numeral 80. It will be understood that variations of the apparatuses shown in the illustrations are possible and that features can be combined in any suitable combination. The drawings are generally drawn to scale. However, other dimensions are possible. It will be appreciated that the swaddle blanket 10 and band 80 may assume different orientations in use.

As shown in FIGS. 1-32, three exemplary methods of use are shown. More particularly, as shown in FIGS. 1-11A, the blanket 10 and band 80 may be used together with the band 80 optionally attaching to the blanket 10. As shown in FIGS. 12-17 and 27-32, the blanket 10 may be used without the band 80. And as shown in FIGS. 18-26, the band 80 may be used without the blanket 10.

The blanket 10 and band 80 may use any combination of features described herein. For example, as described below, the blanket 10 and band 80 may utilize panels 70*a-d* and 74*a-c* of hook and loop fasteners 16 and 20 (e.g., silent hook and loop fasteners) that may be sewn onto a base fabric panel 62 to allow for ease of swaddling and provide a fastening mechanism. In addition, as shown in FIGS. 10-11 and 16-17, the blanket 80 may utilize a strap 36 that folds and attaches to itself (e.g., using mating loop and hook fasteners to form a loop) to secure a lower portion of the blanket 10 and provide size adjustability/remove excess slack at the lower portion of the blanket 10.

In some embodiments, as shown in FIGS. 1-32, the swaddle blanket 10 may comprise a blanket body 12, which may comprise one or more of the following: a) a blanket front 14; b) a blanket rear 18; c) a blanket thickness 22 extending from the blanket front 14 to the blanket rear 18; d) a blanket top 24; e) a blanket bottom 26; f) a blanket height 28 extending from the blanket top 24 to the blanket bottom 26 and perpendicular to the blanket thickness 22; g) a blanket left side 30; h) a blanket right side 32; and/or i) a blanket width 34 extending from the blanket left side 30 to the blanket right side 32 and perpendicular to the blanket height 28 and blanket thickness 22. In some embodiments, the blanket rear 18 and blanket front 14 comprise mating blanket male and female fasteners 20 and 16 (e.g., mating hook and loop fasteners) that allow the swaddle blanket 10 to secure to itself as it wraps around a child 60, as shown in FIGS. 1-32. For example, in some embodiments, as shown in FIGS. 1-32, the blanket body 12 may further comprise: j) one or more base fabric panels 62 that may comprise a front. 64 forming a portion of the blanket front 14 and/or a rear 66 forming a portion of the blanket rear 18; k) a plurality of female fastener panels 68*a-d* sewn to the one or more base fabric panels 62; and/or l) a plurality of male fastener panels 74*a-c* sewn to the one or more base fabric panels 62. Optionally, as shown in FIGS. 1-32, at least some of the female fastener panels 68*a-d* comprise a front 70*a-d* that may form a portion of the blanket front 14 and may comprise blanket female fasteners 16 (e.g., loop fasteners). Optionally, as shown in FIGS. 1-32, at least some of the male fastener panels 74*a-c* comprise a rear 78*a-c* that may form a portion of the blanket rear 18 and may comprise male fasteners 20 (e.g., hook fasteners) configured to releasably attach to the female fasteners 16. It will be understood that the positioning of the male and female fasteners 20 and 16 may be swapped so that the blanket rear 18 includes blanket female fasteners 16 and the blanket front 14 includes blanket male fasteners 20, in which case, the female fastener panels 68*a-d* may comprise a rear comprising the blanket female fasteners 16 and the male fastener panels 74*a-c* may comprise a front comprising the blanket male fasteners 20. Optionally, as shown in FIGS. 1-32, the blanket left side 30 is foldable relative to the blanket right side 32 to allow the blanket body 12 to wrap around and swaddle a child.

Optionally, as shown in FIGS. 1-32, the female fastener 20 is a silent loop fastener and the male fastener 16 is a silent hook fastener so that attaching the female and male fasteners 16 and 20 does not awaken the child 60.

Optionally, as best seen in FIGS. 27-30, the portions of the blanket rear 18 that are aligned heightwise and widthwise with the female fastener panel fronts 70*a-d* do not include a hook or loop fastener and the portions of the blanket front 14 that are aligned heightwise and widthwise with the male fastener panels rear 78*a-c* do not include a hook or loop fastener—i.e., optionally, there are no loop fasteners directly in front of the hook fasteners 20 and there are no hook fasteners directly behind the loop fasteners 16.

In some embodiments, the base fabric panel 62 has the same shape and size as the blanket body 12 and the male fastener panels 74*a-c* are sewn to pre-determined locations/portions of the base fabric panel rear 66, and the female fastener panels 68*a-d* are sewn to pre-determined portions of the base fabric panel front 64. Optionally, as shown in FIGS. 1-32, the blanket thickness 22 is variable (due to the fact that in some places, the male and female fastener panels 68*a-d* are sewn behind and in front of the base fabric panel 62). Exemplary seams 100 are shown in FIGS. 27-30. It was observed silent hook and loop fasteners are a very challenging material, as once cut, they tend to release strands from the cut edge, if they are not "sealed in" or burned (as they may be 100% polyester). Thus, to reduce fraying it was advantageous to employ overlock stitching to eliminate an exposed cut edge facing out. In particular, ISO standard 605 (stitch is formed with 3-needle threads, a top cover thread and a bottom looper thread) was employed. Alternatively, the base fabric panel 62 may have cut-outs and the female and male fastener panels 68*a-d* and 74*a-c* may be positioned in the cut-out areas.

Optionally, as shown in FIGS. 1-32, to maximize the surface area of contact between the male and female fasteners 20 and 16, for each female fastener panel 68*a-d*, the respective female fastener 16 forms/covers substantially all of the female fastener panel front 70*a-d*, and for each male fastener panel 74*a-c*, the respective male 20 fastener forms/covers substantially all of the male fastener panel rear 78*a-c*.

Optionally, as shown in FIGS. 1-32, the right side of the blanket front 14 comprises an upper female fastener panel 68*a* comprising a front 70*a* comprising a loop fastener 16, a middle female fastener panel 68*b* located below the upper female fastener panel 68*a* and comprising a front 70*b* comprising a loop fastener 16, and a lower female fastener panel 68*c* located below the middle female fastener panel 68*b* and comprising a front 70*c* comprising a loop fastener 16. Optionally, as shown in FIGS. 1-32, the left side of the blanket rear 18 comprises an upper male fastener panel 74*a* aligned vertically with the upper female fastener panel 68*a* and comprising a rear 78*a* comprising a hook fastener 20, a middle male fastener panel 74*b* located below the upper male fastener panel 74*a* and aligned vertically with the middle female fastener panel 68*b* and comprising a rear 78*b* comprising a hook fastener 20, and a lower male fastener panel 74*c* located below the middle male fastener panel 74*b* and aligned vertically with the lower female fastener panel 68*c* and comprising a rear 78*c* comprising a hook fastener 20. Optionally, as shown in FIGS. 1-32, the upper female fastener panel 68*a* is the same size and shape as the upper male fastener panel 74*a*, the middle female fastener panel 68*b* is the same size and shape as the middle male fastener panel 74*b*, and the lower female fastener panel 68*c* is the same size and shape as the lower male fastener panel 74*c*.

Optionally, as shown in FIGS. 1-32, to allow for attachment of a band 80, the blanket front 14 further comprises a center female fastener panel 68*d* located between the upper female fastener panel 68*a* and the upper male fastener panel 74*a* and comprising a front 70*d* comprising a loop fastener 16. In such embodiments, as shown in FIGS. 1-32, the removable band 80 may be rectangular and may comprise a rear 82 comprising a hook fastener 98 configured to releasably attach to the loop fastener 16 of the center female fastener panel 68*d*.

Optionally, as shown in FIGS. 1-32, the one or more base fabric panels 62 are located between the upper female fastener panel 68*a* and the middle female fastener panel 68*b* and between the middle female fastener panel 68*b* and the lower female fastener panel 68*c* so that the female fastener panels 60*a-c* are not contiguous.

Optionally, as shown in FIGS. 1-32, the width 86*a* of the upper female fastener panel 68*a* is greater than the width 86*b* of the middle female fastener panel 68*b* and/or the width 86*b* of the middle female fastener panel 68*b* is greater than the width 86*c* of the lower female fastener panel 68*c*.

Optionally, as shown in FIGS. 1-32, the height 90*a* of the upper female fastener panel 68*a* is greater than the height 90*b* of the middle female fastener panel 68*b* and/or the height 90*c* of the lower female fastener panel 68*c* is greater than the height 90*b* of the middle female fastener panel 68*b*.

The blanket 10 may be made of any suitable material. Optionally, the base fabric panel 62, the male fastener panels 74*a-c* and the female fastener panels 68*a-d* are comprised of different materials. For example, optionally, the base fabric panel 62 is comprised of modal fabric. Optionally, the male fastener panel rear 78*a-c* is comprised of velvet. Optionally, the blanket female fastener panel front 70*a-d* is comprised of loop fabric. It will be appreciated that other materials are possible.

Figure 11:
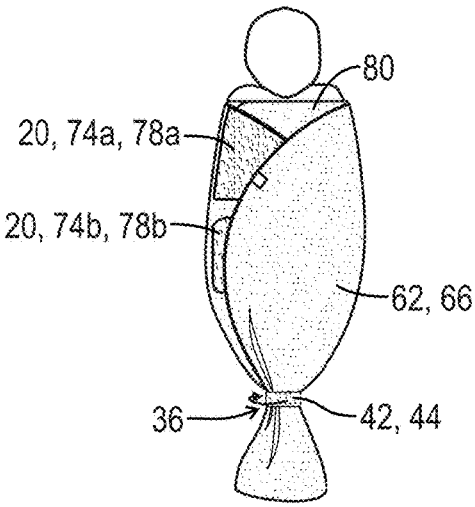
Figure 11A:
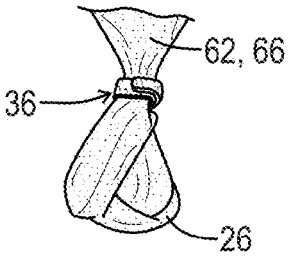
Figure 12:
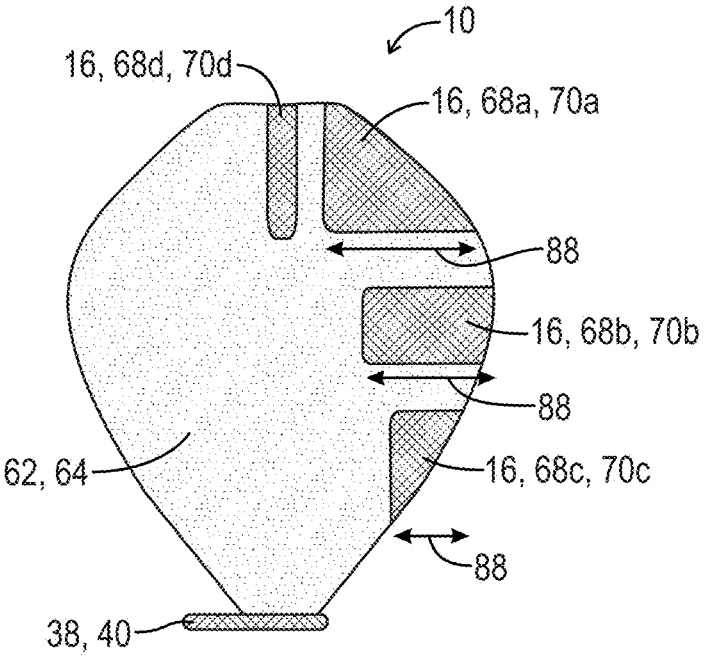
FIGS. 12-17 illustrate, in a stepwise manner, how the swaddle blanket of FIG. 1 may be used without the band to swaddle a child.
Figure 13:
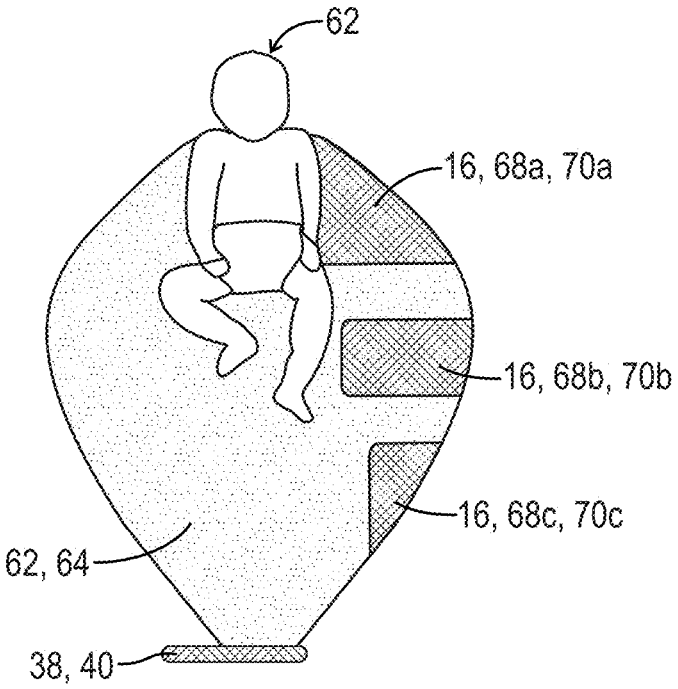
Figure 14:
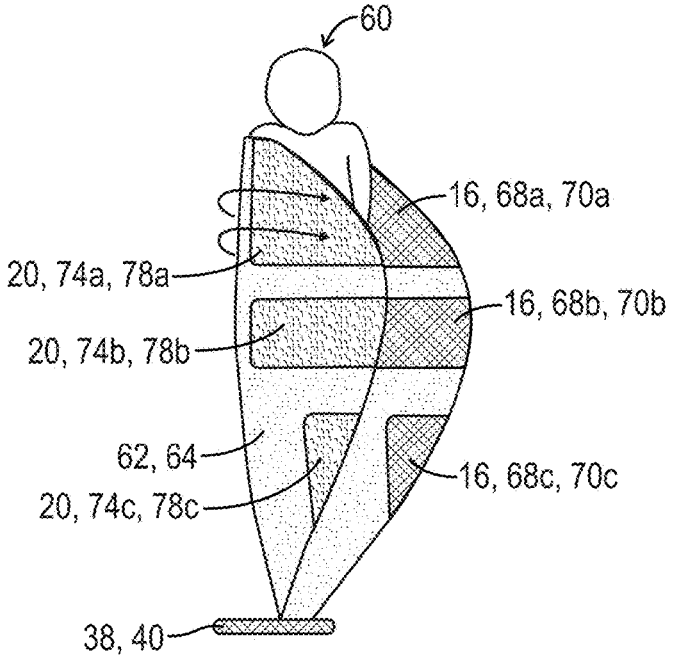
Figure 15:
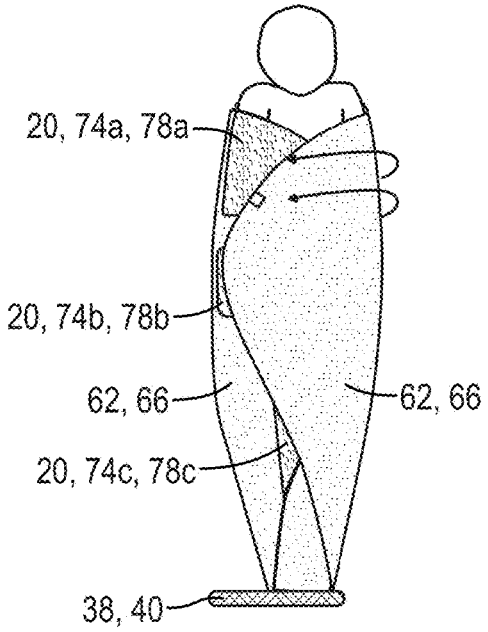
Figure 16:
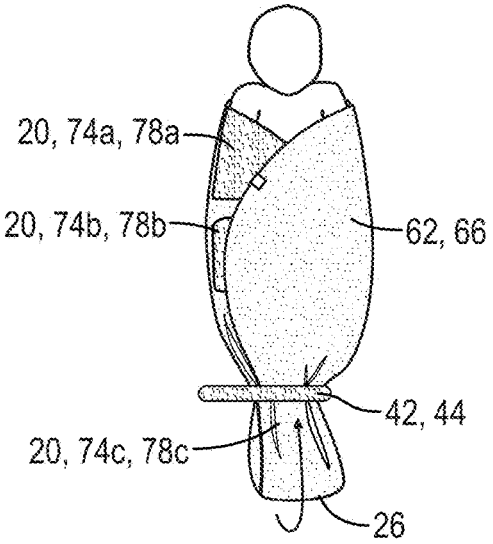
Figure 17:
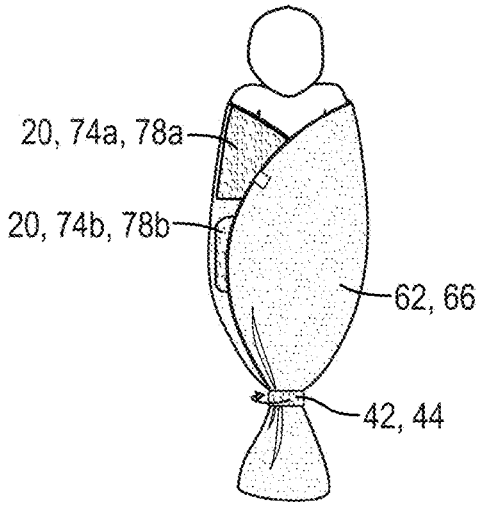
Figure 18:
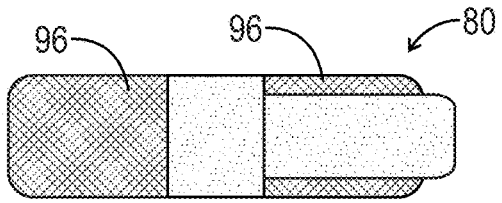
FIGS. 18-23 illustrate, in a stepwise manner, how the band of FIG. 1 may be used without the swaddle blanket to swaddle a child.
Figure 19:
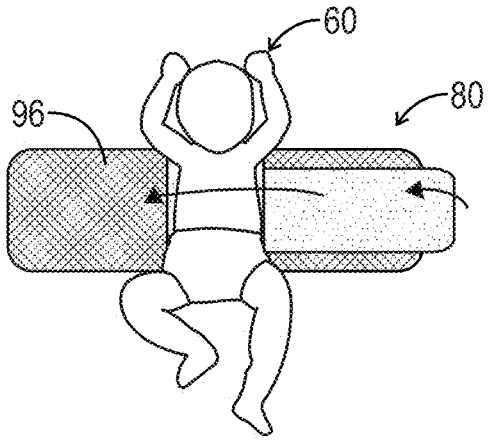
Figure 20:
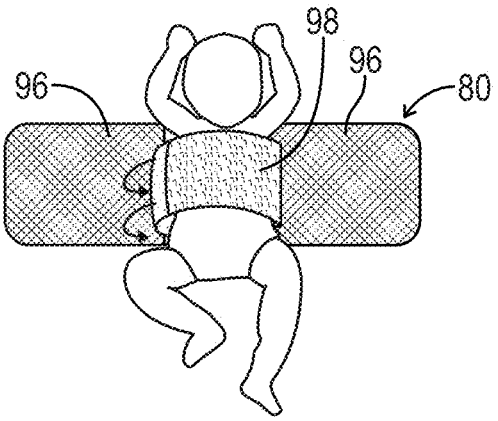
Figure 21:
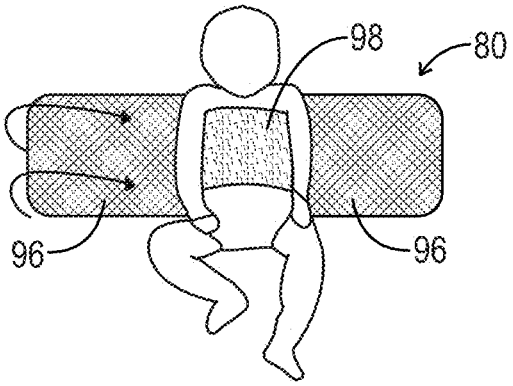
Figure 22:
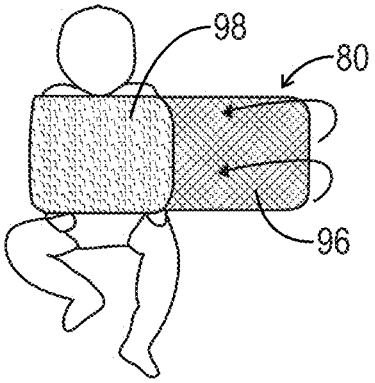
Figure 23:
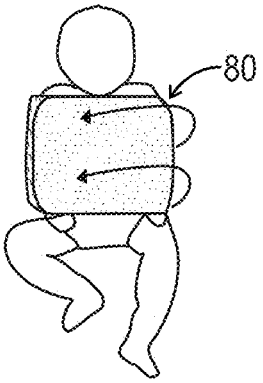
Figure 24:
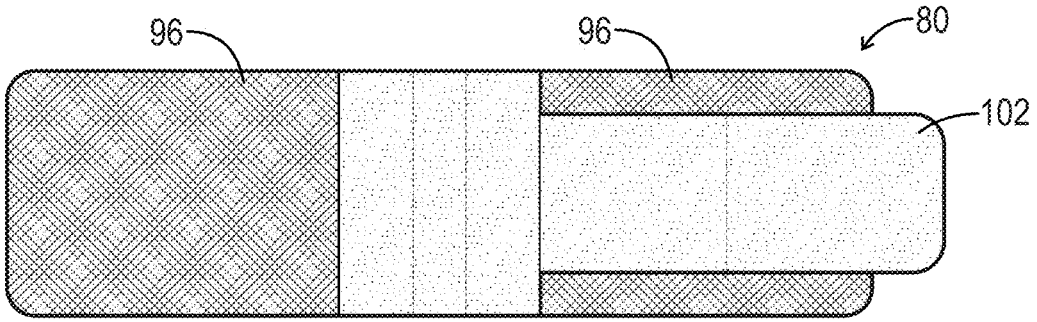
FIGS. 24-25 illustrate front elevation views of the band of FIG. 1.
Figure 25:
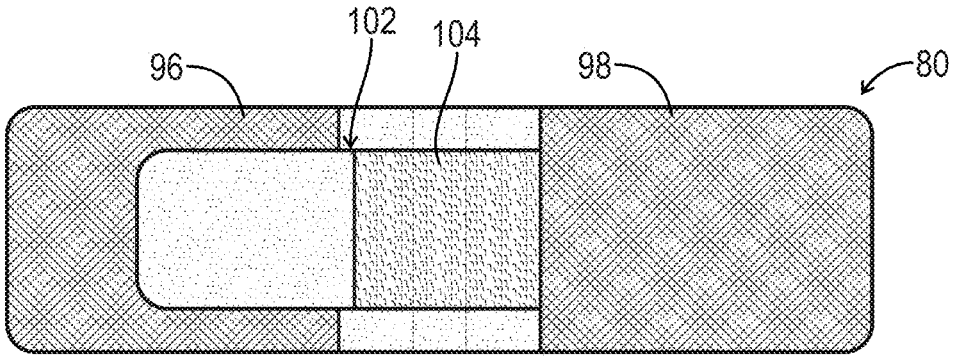
Figure 26:
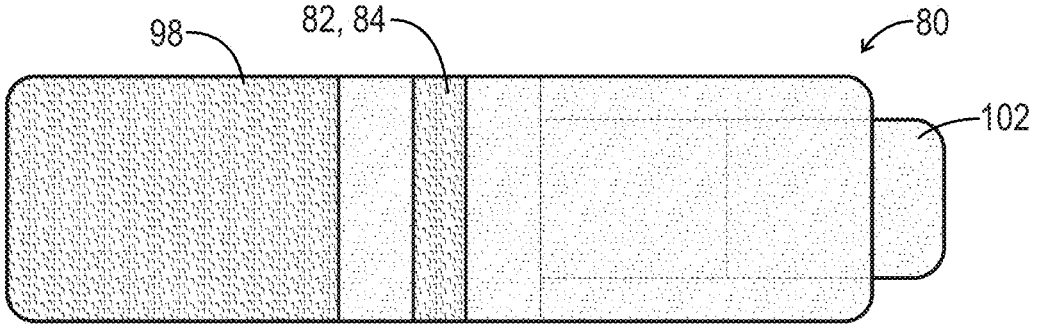
FIG. 26 illustrates a rear elevation view of the band of FIG. 1.
Figure 27:
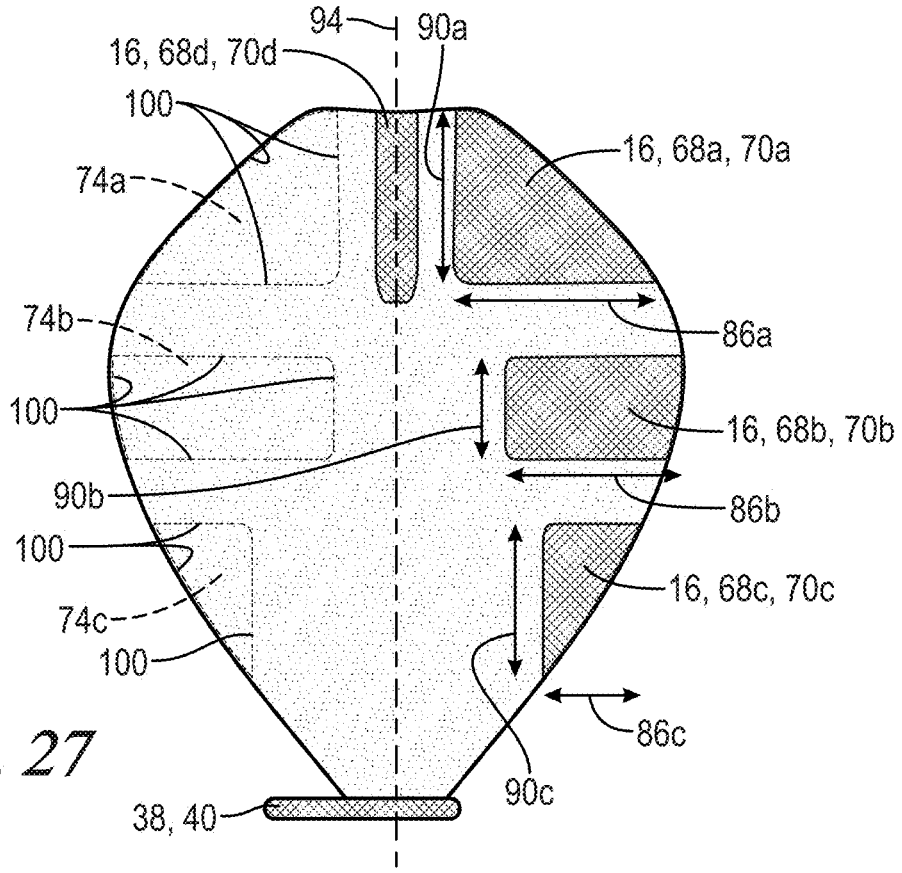
FIG. 27 illustrates a front elevation view of the swaddle blanket of FIG. 1.
Figure 28:
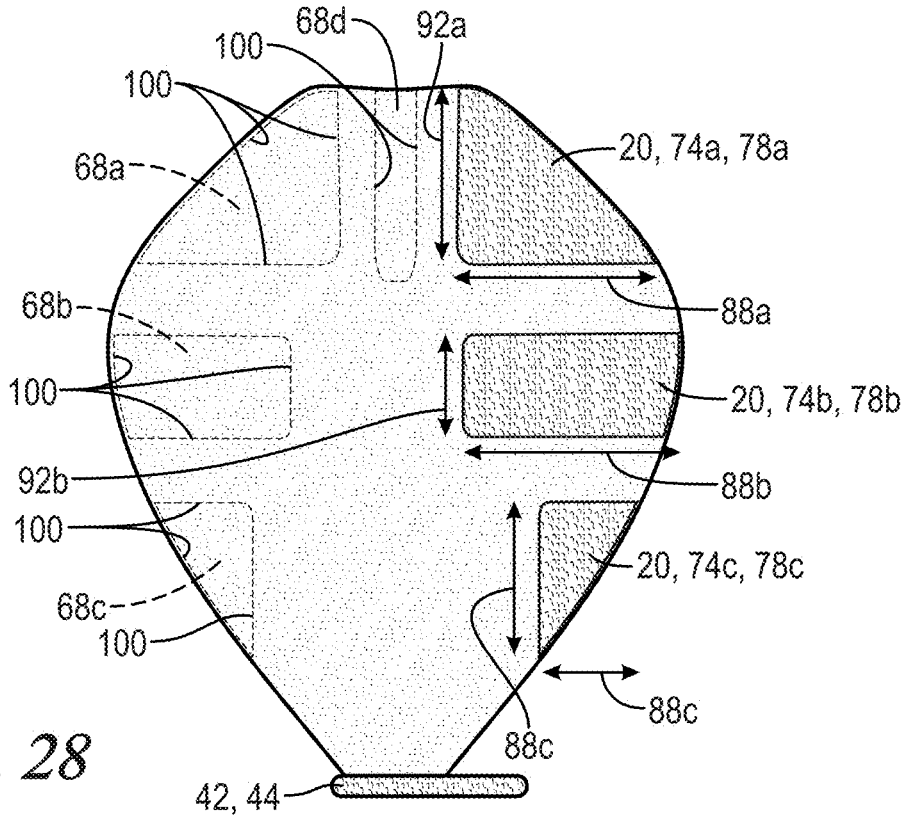
FIG. 28 illustrates a rear elevation view of the swaddle blanket of FIG. 1.
Figure 29:
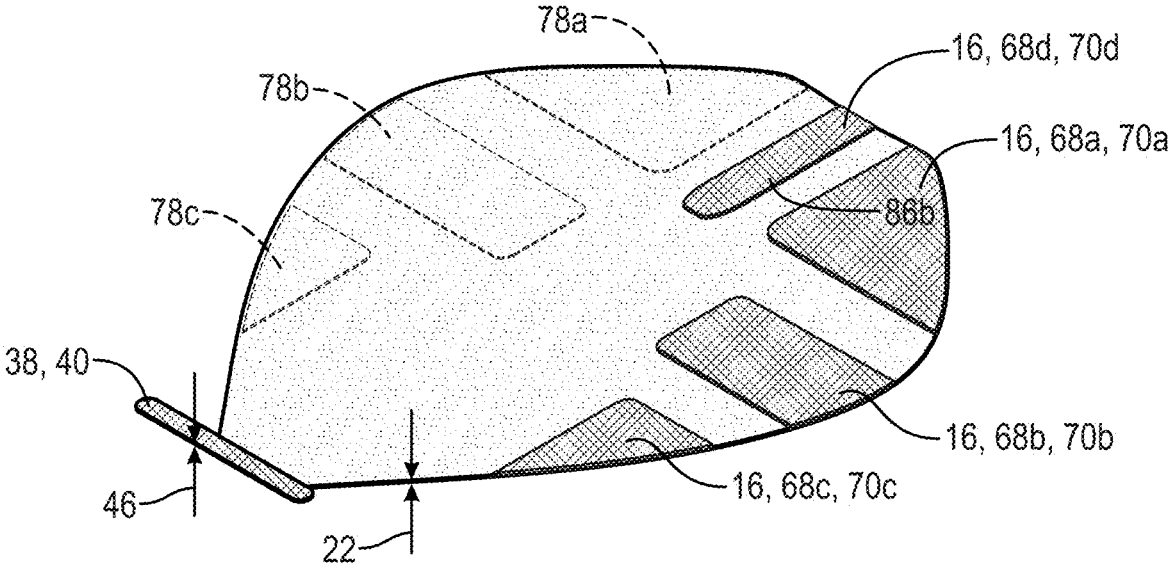
FIG. 29 illustrates a front perspective view of the swaddle blanket of FIG. 1.
Figure 30:
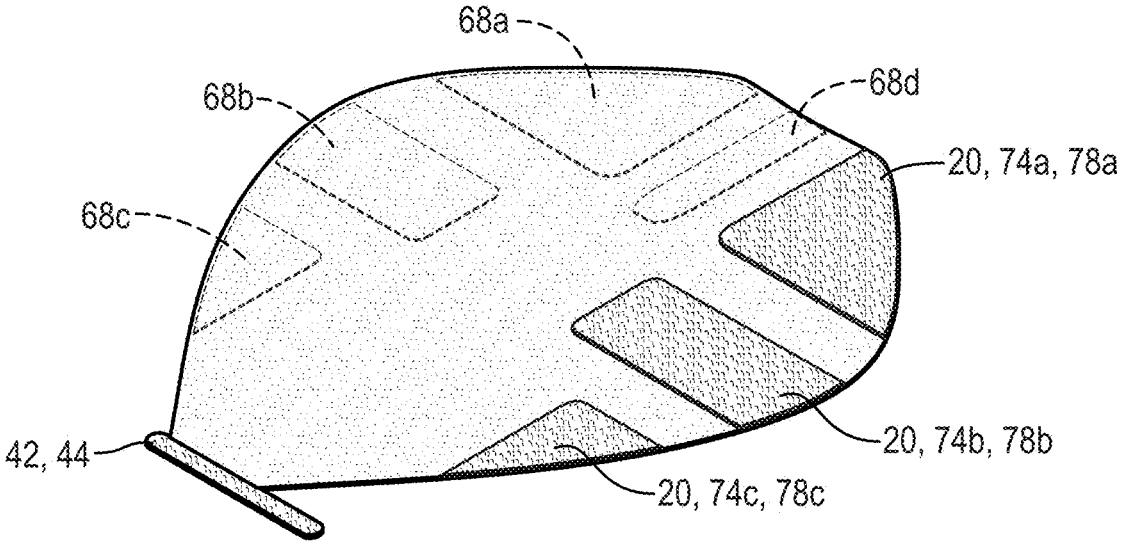
FIG. 30 illustrates a rear perspective view of the swaddle blanket of FIG. 1.

Optionally, as shown in FIGS. 1-32, the blanket 10 further comprises a strap 36, which may be located adjacent (i.e., at or near) the blanket bottom 26 and may comprise a strap front 38 comprising a strap front fastener 40, a strap rear 42 comprising a strap rear fastener 44 configured to releasably attach to the strap front fastener 40, a strap thickness 46 extending from the strap front 38 to the strap rear 42 and parallel to the blanket thickness 22, a strap left side 48, a strap right side 50, a strap width 52 extending from the strap left side 48 to the strap right side 50 and perpendicular to the strap thickness 46, a strap top 54, a strap bottom 56, and/or a strap height 58 extending from the strap top 54 to the strap bottom 56 and perpendicular to the strap width 52 and the strap thickness 46 and parallel to the blanket height 28. As shown in FIGS. 10-11A and 16-17, the strap 36 may be configured to transition from a flat position in which the strap 36 is flat to a looped position in which the strap 36 removably folds around itself and the strap front fastener 40 attaches to the strap rear fastener 44 so that the strap 36 forms a loop located in front of the blanket front 14 and/or located to the rear of the blanket rear 18 and further secures the swaddle blanket 10 around the child 60. Optionally, as shown in FIGS. 1-32, the strap front fastener 40 is a loop fastener and further wherein the strap rear fastener 44 is a hook fastener. Optionally, as shown in FIGS. 1-32, to maximize the surface area of attachment, the strap front fastener 40 covers the strap front 38 and/or the strap rear fastener 44 covers the strap rear 42. For example in some embodiments, the strap 36 consists merely of the strap front fastener 40 sewn to the strap rear fastener 44. Optionally, as shown in FIGS. 1-32, the strap rear 42 is located to the rear of the blanket rear 18 in the flat position and in the looped position. Optionally, the loop is located to the rear of the blanket rear 18 in the looped position. Optionally, the strap 36 partially overlaps itself in the looped position, as shown in FIG. 11A. Optionally, as shown in FIGS. 1-32, the strap width 52 is greater than the strap height 58. Optionally, as shown in FIGS. 1-32, the strap 36 is located below the blanket bottom 26 and the strap width 52 is greater than the blanket width 34 at the blanket bottom 26. The strap 36 may be any suitable dimension. Optionally, as shown in FIG. 1, strap 36 is offset relative to the center of the blanket width 54—i.e., the strap right side 50 or strap left side 48 extends a greater distance from the center of the blanket width 34 (as compared to the other side 48 or 50 of the strap 36) to facilitate the strap 36 attaching to itself. For example, in FIG. 1, the strap left side 48 extends about 3-5 inches laterally from the blanket left side 30 whereas the strap right side 50 extends only about 0.25 inches to about 2 inches (e.g., 0.5 inches) from the blanket right side 32. Optionally, the strap width 52 is from about 5 inches to about 10 inches and/or the strap height 58 is from about 0.5 inches to about 2 inches. Optionally, the blanket width 34 is variable and comprises a maximum width of between about 25 inches and about 35 inches. Optionally, the blanket height 28 is between about 25 inches and about 35 inches. Optionally, the blanket thickness 22 is between about 0.001 inches and about 0.5 inches.

Optionally, as shown in FIGS. 1-32, except for the strap 36, the swaddle blanket 10 is symmetrical about a longitudinal axis 94 extending from a widthwise center of the blanket top 24 to a widthwise center of the blanket bottom 26, said longitudinal axis 94 parallel to the blanket height 28.

Optionally, as shown in FIGS. 1-32, the blanket front 14 does not have any hook fasteners 20 and/or the blanket rear 18 does not have any loop fasteners 16.

Optionally, as shown in FIGS. 1-32, one or more of the of loop fasteners 16 is aligned along the blanket height 28 with a hook fastener 20. Preferably, except for the center female fastener panel 68*d* (which attaches to the removable rectangular band 80), each female fastener panel 68*a-c* is aligned vertically with a male fastener panel 74*a-c*.

Optionally, as shown in FIGS. 1-32, the removable rectangular band 80 comprises a rear 82 comprising a first hook fastener 98, and a second hook fastener 84 (i.e., a blanket attachment fastener) configured to releasably attach to a blanket loop fastener 68*d*. Optionally, as shown in FIGS. 1-32, the removable rectangular band 80 comprises a front comprising a loop fastener 96 configured to releasably attach to the first hook fastener 98. As shown in FIGS. 1-32, the removable rectangular band 80 may also include a flap 102. Optionally, one side of the flap 102 may include a flap male fastener 104.

Optionally, as shown in FIGS. 1-32, the swaddle blanket 10 comprising a middle segment located between the blanket top 24 and blanket bottom 26, and further wherein the blanket width 34 at the middle segment is greater than the blanket width 34 at the blanket top 24 and blanket bottom 26. Optionally, as shown in FIGS. 1-32, the blanket width 34 at the blanket top 24 is greater than the blanket width 34 at the blanket bottom 26.

Figure 31:
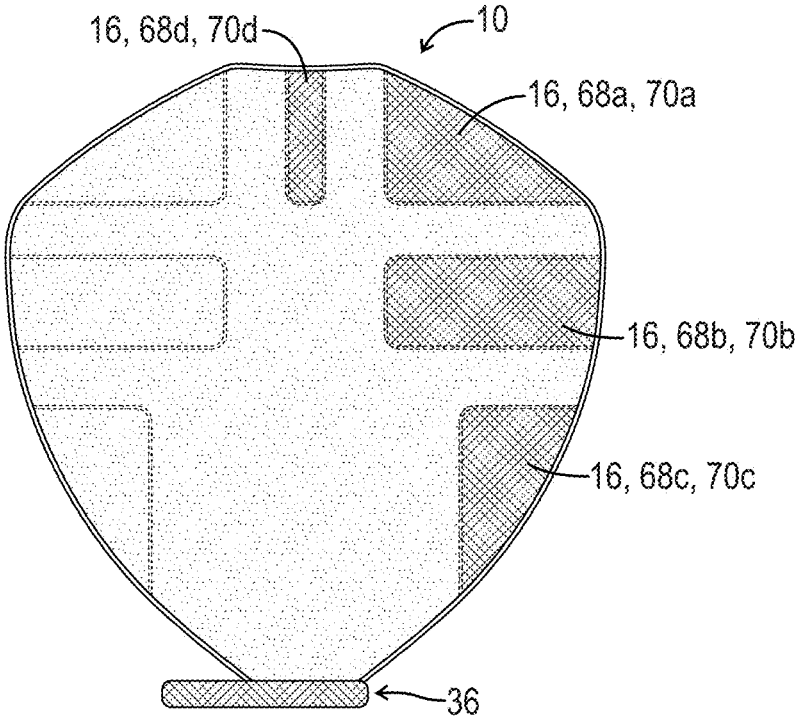
FIG. 31 illustrates a front elevation view of a swaddle blanket in accordance with another embodiment of the present invention.
Figure 32:
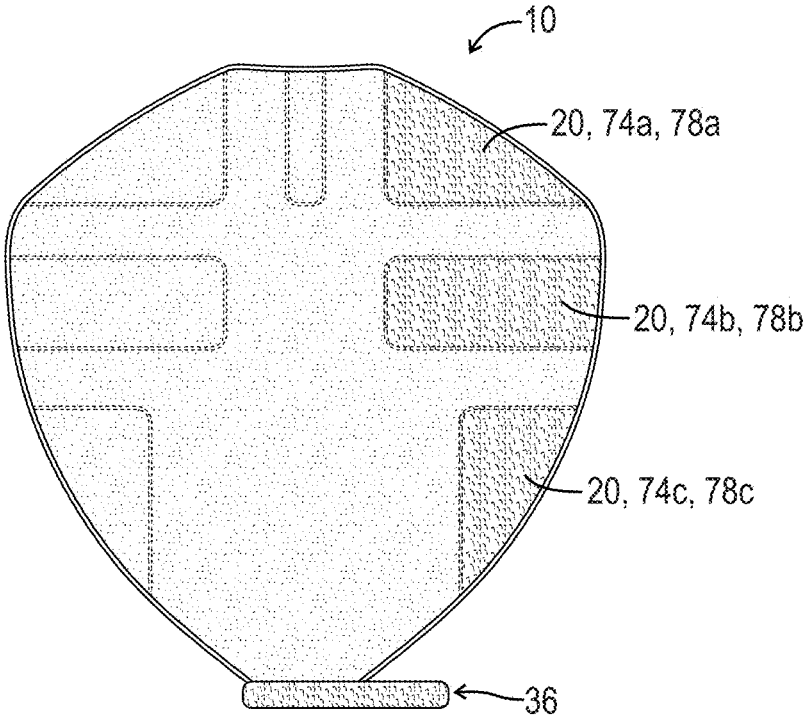
FIG. 32 illustrates a rear elevation view of the swaddle blanket of FIG. 31.

The shape of the blanket body 12 and fastener panels 68*a-d* and 74*a-c* of the swaddle blanket 10 shown in FIGS. 31-32 are slightly different than those of the swaddle blanket 12 shown in FIGS. 1-30.

The swaddle blanket 10 may be used in any suitable method. For example, as shown in FIGS. 1-32, the swaddle blanket 10 may be used in a method that comprises a) providing the swaddle blanket 10; b) placing a child 60 on the blanket front 14; and c) wrapping the swaddle blanket 10 around the child 60. Optionally, as shown in FIGS. 1-32, the method further comprises d) releasably attaching at least one male fastener panel 74*a-c* to at least one blanket female fastener panel 68*a-d*. Optionally, as shown in FIGS. 1-32, the method further comprises e) attaching the strap front fastener 40 to the strap rear fastener 44. Optionally, as shown in FIGS. 10-11A and 16-17, the step of folding the blanket bottom 26 upwards towards the blanket top 24 occurs before step e).

| Part List | |
|---|---|
| swaddle blanket | 10 |
| blanket body | 12 |
| blanket front | 14 |
| blanket female fasteners (e.g., loop fasteners) | 16 |
| blanket rear | 18 |
| blanket male fasteners (e.g., hook fasteners) | 20 |
| blanket thickness | 22 |
| blanket top | 24 |
| blanket bottom | 26 |
| blanket height | 28 |
| blanket left side | 30 |
| blanket right side | 32 |
| blanket width | 34 |
| strap | 36 |
| strap front | 38 |
| strap front fastener | 40 |
| strap rear | 42 |
| strap rear fastener | 44 |
| strap thickness | 46 |
| strap left side | 48 |
| strap right side | 50 |
| strap width | 52 |
| strap top | 54 |
| strap bottom | 56 |
| strap height | 58 |
| child | 60 |
| base fabric panel | 62 |
| base fabric panel front | 64 |
| base fabric panel rear | 66 |
| female fastener panel (upper, middle, lower, and center) | 68a-d |
| female fastener panel front | 70a-d |
| female fastener panel rear | Not shown |
| male fastener panel (upper, middle, and lower) | 74a-c |
| male fastener panel front | Not shown |
| male fastener panel rear | 78a-c |
| band | 80 |
| band rear | 82 |
| male band attachment fastener | 84 |
| width of female fastener panels | 86a-c |
| width of male fastener panel | 88a-c |
| height of female fastener panel (upper middle, and lower) | 90a-c |
| height of male fastener panel | 92a-c |
| longitudinal axis/centerline | 94 |
| female band fastener (loop fastener) | 96 |
| male band fastener (first hook fastener) | 98 |
| seams | 100 |
| flap | 102 |
| flap male fastener | 104 |

Those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed. Use of the singular embraces the plural.

Terms of degree such as "generally", "substantially", "about", and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A swaddle blanket comprising:

a) a blanket body comprising:

i) a blanket front ii) a blanket rear;

iii) a blanket thickness extending from the blanket front to the blanket rear;

iv) a blanket top;

v) a blanket bottom;

vi) a blanket height extending from the blanket top to the blanket bottom and perpendicular to the blanket thickness;

vii) a blanket left side;

viii) a blanket right side;

ix) a blanket width extending from the blanket left side to the blanket right side and perpendicular to the blanket height and blanket thickness;

x) one or more base fabric panels comprising a front forming a portion of the blanket front and a rear forming a portion of the blanket rear;

xi) a plurality of female fastener panels sewn to the front of the one or more base fabric panels, wherein at least some of the female fastener panels comprise a front forming a portion of the blanket front and comprising loop fasteners; and xii) a plurality of male fastener panels sewn to the rear of the one or more base fabric panels, wherein at least some of the male fastener panels comprise a rear forming a portion of the blanket rear and comprising hook fasteners configured to releasably attach to the loop fasteners, wherein the blanket left side is foldable relative to the blanket right side to allow the blanket body to wrap around and swaddle a child; and b) a strap located adjacent the blanket bottom and comprising a strap front comprising a strap front fastener covering the strap front, a strap rear comprising a strap rear fastener covering the strap rear configured to releasably attach to the strap front fastener, a strap thickness extending from the strap front to the strap rear and parallel to the blanket thickness, a strap left side, a strap right side, a strap width extending from the strap left side to the strap right side and perpendicular to the strap thickness, a strap top, a strap bottom, and a strap height extending from the strap top to the strap bottom and perpendicular to the strap width and the strap thickness and parallel to the blanket height, wherein one of the strap front fastener and the strap rear fastener is a hook fastener and the other of the strap front fastener and the strap rear fastener is a loop fastener, wherein the strap is configured to transition from a flat position in which the strap is flat to a looped position in which the strap removably folds around and overlaps itself and the strap front fastener attaches to the strap rear fastener so that the strap forms a loop.

2. The swaddle blanket of claim 1, wherein the plurality of female fastener panels are sewn to the front of the one or more base fabric panels via overlock stitching and the plurality of male fastener panels sewn to the rear of the one or more base fabric panels via overlock stitching.

3. The swaddle blanket of claim 1 wherein one of the strap front and the strap rear consists of loop fabric and the other of the strap front and the strap rear consists of hook fabric and further wherein the loop fabric is sewn to the hook fabric.

4. The swaddle blanket of claim 1 wherein the strap front fastener covers the strap front and/or the strap rear fastener covers the strap rear.

5. The swaddle blanket of claim 1 wherein the strap rear is located to the rear of the blanket rear in the flat position and in the looped position.

6. The swaddle blanket of claim 1 wherein the loop is located to the rear of the blanket rear in the looped position.

7. The swaddle blanket of claim 1 wherein the strap is located below the blanket bottom and further wherein the strap width is greater than the blanket width at the blanket bottom.

8. The swaddle blanket of claim 1 wherein the strap width and the blanket width each comprise a center and further wherein the center of the strap width is offset laterally relative to the center of the blanket width.

9. The swaddle blanket of claim 1 wherein one or more of the of loop fasteners is aligned along the blanket height with a hook fastener.

10. The swaddle blanket of claim 1 wherein the blanket body is symmetrical about a longitudinal axis extending from a widthwise center of the blanket top to a widthwise center of the blanket bottom, said longitudinal axis parallel to the blanket height.

11. The swaddle blanket of claim 1 wherein the hook fasteners and loop fasteners are silent hook and loop fasteners.

12. The swaddle blanket of claim 1 wherein the portions of the blanket rear that are aligned heightwise and widthwise with the female fastener panel fronts do not include a hook or loop fastener and further wherein the portions of the blanket front that are aligned heightwise and widthwise with the male fastener panel rears do not include a hook or loop fastener.

13. The swaddle blanket of claim 1, wherein for each female fastener panel, the respective loop fastener covers substantially all of the female fastener panel front, and wherein for each male fastener panel, the respective hook fastener covers substantially all of the male fastener panel rear.

14. The swaddle blanket of claim 1 wherein the right side of the blanket front comprises an upper female fastener panel comprising a front comprising a loop fastener, a middle female fastener panel located below the upper female fastener panel and comprising a front comprising a loop fastener, and a lower female fastener panel located below the middle female fastener panel and comprising a front comprising a loop fastener.

15. The swaddle blanket of claim 14 wherein the left side of the blanket rear comprises an upper male fastener panel aligned vertically with the upper female fastener panel and comprising a rear comprising a hook fastener, a middle male fastener panel located below the upper male fastener panel and aligned vertically with the middle female fastener panel and comprising a rear comprising a hook fastener, and a lower male fastener panel located below the middle male fastener panel and aligned vertically with the lower female fastener panel and comprising a rear comprising a hook fastener.

16. The swaddle blanket of claim 15 wherein the upper female fastener panel is the same size and shape as the upper male fastener panel, wherein the middle female fastener panel is the same size and shape as the middle male fastener panel, and further wherein the lower female fastener panel is the same size and shape as the lower male fastener panel.

17. The swaddle blanket of claim 15 wherein the blanket front further comprises a center female fastener panel located between the upper female fastener panel and the upper male fastener panel and comprising a front comprising a loop fastener.

18. The swaddle blanket of claim 17 further comprising a removable rectangular band comprising a rear comprising a hook fastener configured to releasably attach to the loop fastener of the center female fastener panel.

19. The swaddle blanket of claim 15 wherein the one or more base fabric panels is located between the upper female fastener panel and the middle female fastener panel, and between the middle female fastener panel and the lower female fastener panel.

20. The swaddle blanket of claim 15 wherein the width of the upper female fastener panel is greater than the width of the middle female fastener panel and further wherein the width of the middle female fastener panel is greater than the width of the lower female fastener panel.

21. The swaddle blanket of claim 15 wherein the height of the upper female fastener panel is greater than the height of the middle female fastener panel and/or the height of the lower female fastener panel is greater than the height of the middle female fastener panel.

22. The swaddle blanket of claim 1 wherein the blanket front does not have any hook fasteners and the blanket rear does not have any loop fasteners.

23. The swaddle blanket of claim 1 wherein the plurality of female fastener panels and the plurality of male fastener panels are comprised of a different material than the one or more base fabric panels.

* * * * *